US008295497B2

(12) United States Patent
Roeck et al.

(10) Patent No.: US 8,295,497 B2
(45) Date of Patent: Oct. 23, 2012

(54) METHOD FOR OPERATING A BINAURAL HEARING SYSTEM AS WELL AS A BINAURAL HEARING SYSTEM

(75) Inventors: Hans-Ueli Roeck, Hombrechtikon (CH); Manuela Feilner, Herrliberg (CH)

(73) Assignee: Phonak AG, Staefa (CH)

( * ) Notice: Subject to any disclaimer, the term of this patent is extended or adjusted under 35 U.S.C. 154(b) by 820 days.

(21) Appl. No.: 12/373,151

(22) PCT Filed: Jul. 5, 2007

(86) PCT No.: PCT/EP2007/056848

§ 371 (c)(1),
(2), (4) Date: Mar. 30, 2009

(87) PCT Pub. No.: WO2008/006772

PCT Pub. Date: Jan. 17, 2008

(65) Prior Publication Data

US 2010/0002887 A1 Jan. 7, 2010

Related U.S. Application Data

(60) Provisional application No. 60/807,109, filed on Jul. 12, 2006.

(30) Foreign Application Priority Data

Jul. 12, 2006 (EP) ..... 06117039

(51) Int. Cl.
*H04R 5/00* (2006.01)
*H04R 25/00* (2006.01)

(52) U.S. Cl. ..... 381/23.1; 381/23; 381/312

(58) Field of Classification Search ..... 381/23, 381/23.1, 312

See application file for complete search history.

(56) References Cited

U.S. PATENT DOCUMENTS 6,768,802 B1 * 7/2004 Baechler ..... 381/315
6,839,447 B2 * 1/2005 Nielsen et al. ..... 381/312

(Continued)

FOREIGN PATENT DOCUMENTS

DE 102004035256 B3 9/2005

(Continued)

OTHER PUBLICATIONS

International Search Report for PCT/EP2007/056848 dated Dec. 18, 2007.

(Continued)

*Primary Examiner* — Ori Nadav
(74) *Attorney, Agent, or Firm* — Pearne & Gordon LLP

(57) ABSTRACT

A hearing system and a method for operating a binaural hearing system include at least two hearing devices to be at least partly inserted into or to be worn behind the left and right ear of a user. Each hearing device includes at least one microphone to generate an electrical signal corresponding to an acoustic signal. The method includes determining contra-lateral information based on an acoustic signal recorded by a microphone of the contra-lateral hearing device, and determining ipsi-lateral information based on an acoustic signal recorded by a microphone of the ipsi-lateral hearing device. The method includes providing a coordination level, the coordination level being indicative of a degree of synchronization of the two hearing devices, and adjusting processes in the ipsi-lateral hearing device in accordance with the coordination level. The coordination level can be determined from the contra-lateral information and/or from the ipsi-lateral information, or be obtained from an external device.

18 Claims, 2 Drawing Sheets

U.S. PATENT DOCUMENTS

Figure 1:
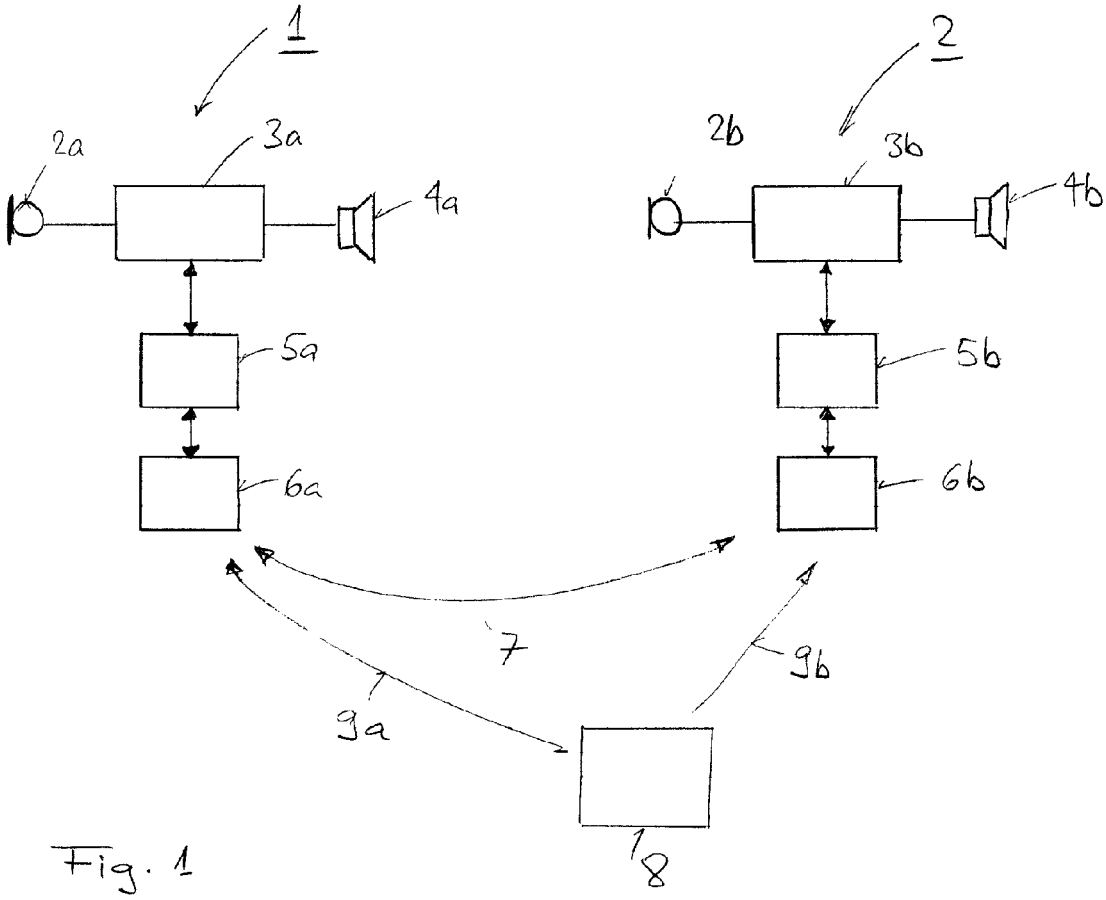

2004/0208332 A1 10/2004 Baechler
2006/0018496 A1 * 1/2006 Niederdrank et al. ..... 381/312

FOREIGN PATENT DOCUMENTS

EP 1558059 A2 7/2005
EP 1651005 A2 4/2006
WO 9641498 A 12/1996
WO 0207479 A1 1/2002

OTHER PUBLICATIONS

Written Opinion for PCT/EP2007/056848 dated Dec. 18, 2007.

* cited by examiner

METHOD FOR OPERATING A BINAURAL HEARING SYSTEM AS WELL AS A BINAURAL HEARING SYSTEM

This specification comprises an annex entitled "Methods for manufacturing audible signals", which is herewith incorporated by reference in its entirety. The annex is enclosed.

The present invention is related to a method for operating a binaural hearing system according to the pre-characterizing part of claim 1 as well as to a binaural hearing system.

In many instances, a hearing impairment affects both ears; so the hearing impaired person should be supplied with hearing devices in both ears. Such hearing systems are called binaural hearing systems when the acoustic situation at both ears is evaluated and also has an impact on signal processing schemes in the contra-lateral hearing device. Modern hearing devices have processing schemes, i.e. signal processing algorithms, that automatically vary the parameters of the hearing devices—also referred to hearing programs—dependent on the momentary acoustic situation. These variations are directed to the switching between microphone modes (omnidirectional or various directional microphone modes) as well as the effect of various stages of the signal processing thereby allowing adaptation to the momentary acoustic situation.

The use of a binaural hearing system is not only advantageous when both ears are affected, but also in cases where only one ear is affected because the acoustic situation can be established more accurately by a hearing system having acoustic input from both sides of the head of the hearing system user. As a result thereof, the hearing system can be adjusted more accurately to the momentary acoustic situation.

However, the evaluation of the acoustic situation at both ears can lead to divergent results regarding the detected momentary acoustic situation, because already a slightly different acoustic situation detected in one hearing device compared to a detected acoustic situation in the other hearing device may result in operating the two hearing devices in different hearing programs. This usually confuses the hearing device user. For example, the acoustic levels measured at the two ears inside of a passenger vehicle can significantly differ; a definitive resolution as to the spatial arrangement of the noise sources also fluctuates greatly. In the case of such a separate evaluation, thus, different settings of the hearing devices can only be avoided with difficulty.

U.S. Pat. No. 5,604,812 discloses a hearing device that has a signal analysis unit for the automatic switching between various hearing programs. The signal analysis unit is able to recognize the current hearing situation and to select a suitable hearing program. In case of a hearing system having two hearing devices, an automatic recognition of the momentary acoustic situation in the hearing devices can lead to different results, and, thus, to the operation of the hearing devices in different hearing programs. Generally, this is not at all desirable and therefore discomforts the hearing system user to a great extent.

In order to overcome the disadvantage of the hearing system disclosed in U.S. Pat. No. 5,604,812, numerous attempts have been elaborated. Reference is made to WO 00/00001 or its equivalent U.S. Pat. No. 6,768,802 B1, respectively, for example, which discloses a binaural hearing system with two hearing devices which are synchronized via a wireless link. As a result of the synchronization, the two hearing devices are always in a pre-selectable mode-pair. Therefore, the term "synchronization" means that both hearing devices are forced to operate in one of the pre-selectable mode-pair. The mode-pair to be active is either selected manually by the hearing system user or automatically by one of the hearing devices itself. As a result of this forced and rigid selection, the operation is sometimes far from optimal.

Furthermore, attention is drawn to EP-A2-1 320 281 that is also directed to a binaural hearing system.

It is therefore an object of the present invention to overcome the above-mentioned disadvantages, and to provide an improved method to operate a binaural hearing system.

This object is accomplished by the measures specified in claim 1. Additional embodiments of the present invention as well as a binaural hearing system are specified in further claims.

The present invention is related to a method for operating a binaural hearing system comprising at least two hearing devices to be at the left and right ear of a user or at least partly inserted into the left and right ear of a user, each hearing device comprising at least one microphone to generate an electrical signal corresponding to an acoustic signal, the method being characterized by the steps of:

- determining contra-lateral information based on an acoustic signal recorded by a microphone of the contra-lateral hearing device,
- determining ipsi-lateral information based on an acoustic signal recorded by a microphone of the ipsi-lateral hearing device,
- providing a coordination level, the coordination level being indicative of a degree of synchronization of the two hearing devices, and
- adjusting processes in the ipsi-lateral hearing device in accordance with the coordination level, wherein the coordination level either being determined from the contra-lateral information and/or from the ipsi-lateral information, or being obtained from an external device.

The inventive hearing system has the advantage that the hearing devices can be operated at different coordination levels resulting in improved hearing ability for the user.

A further embodiment of the present invention further comprises the step of:

- adjusting processes in the contra-lateral hearing device in accordance with the coordination level.

A still further embodiment of the present invention comprises the steps of:

- determining the contra-lateral information in the contra-lateral hearing device, and
- transmitting the contra-lateral information to the ipsi-lateral hearing device.

A yet another embodiment of the present invention comprises the step of transmitting said contra-lateral information via an external device to the ipsi-lateral hearing device.

Another embodiment of the present invention comprises the step determining the ipsi-lateral information in the ipsi-lateral hearing device.

A further embodiment of the present invention comprises the step of determining a coordination level in each of the two hearing devices.

Furthermore, a binaural hearing system is disclosed, comprising:

- at least two hearing devices to be at least partly inserted into or to be worn behind the left and right ear of a user,
- each hearing device comprising at least one microphone to generate an electrical signal corresponding to an acoustic signal,
- means for determining contra-lateral information based on an acoustic signal recorded by a microphone of the contra-lateral hearing device, means for determining ipsi-lateral information based on an acoustic signal recorded by a microphone of the ipsi-lateral hearing device, means for providing a coordination level, the coordination level being indicative of a degree of synchronization of the two hearing devices, and means for adjusting processes in the ipsi-lateral hearing device in accordance with the coordination level, wherein the coordination level either being determined from the contra-lateral information and/or from the ipsi-lateral information, or being obtained from an external device.

A further embodiment of the present invention further comprises means for adjusting processes in the contra-lateral hearing device in accordance with the coordination level.

A still further embodiment of the present invention further comprises means for determining the contra-lateral information in the contra-lateral hearing device, and means for transmitting the contra-lateral information to the ipsi-lateral hearing device.

Another embodiment of the present invention further comprises means for transmitting said contra-lateral information via an external device to the ipsi-lateral hearing device.

A still further embodiment of the present invention further comprises means for determining the ipsi-lateral information in the ipsi-lateral hearing device.

A further embodiment of the present invention further comprises means for determining a coordination level in each of the two hearing devices.

The present invention is further explained in more detail by referring to drawings illustrating exemplified embodiments of the present invention.

Figure 2:
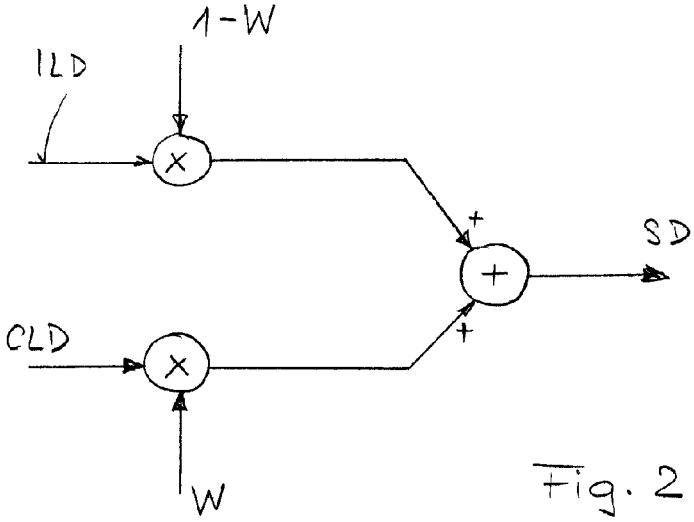
Figure 3:
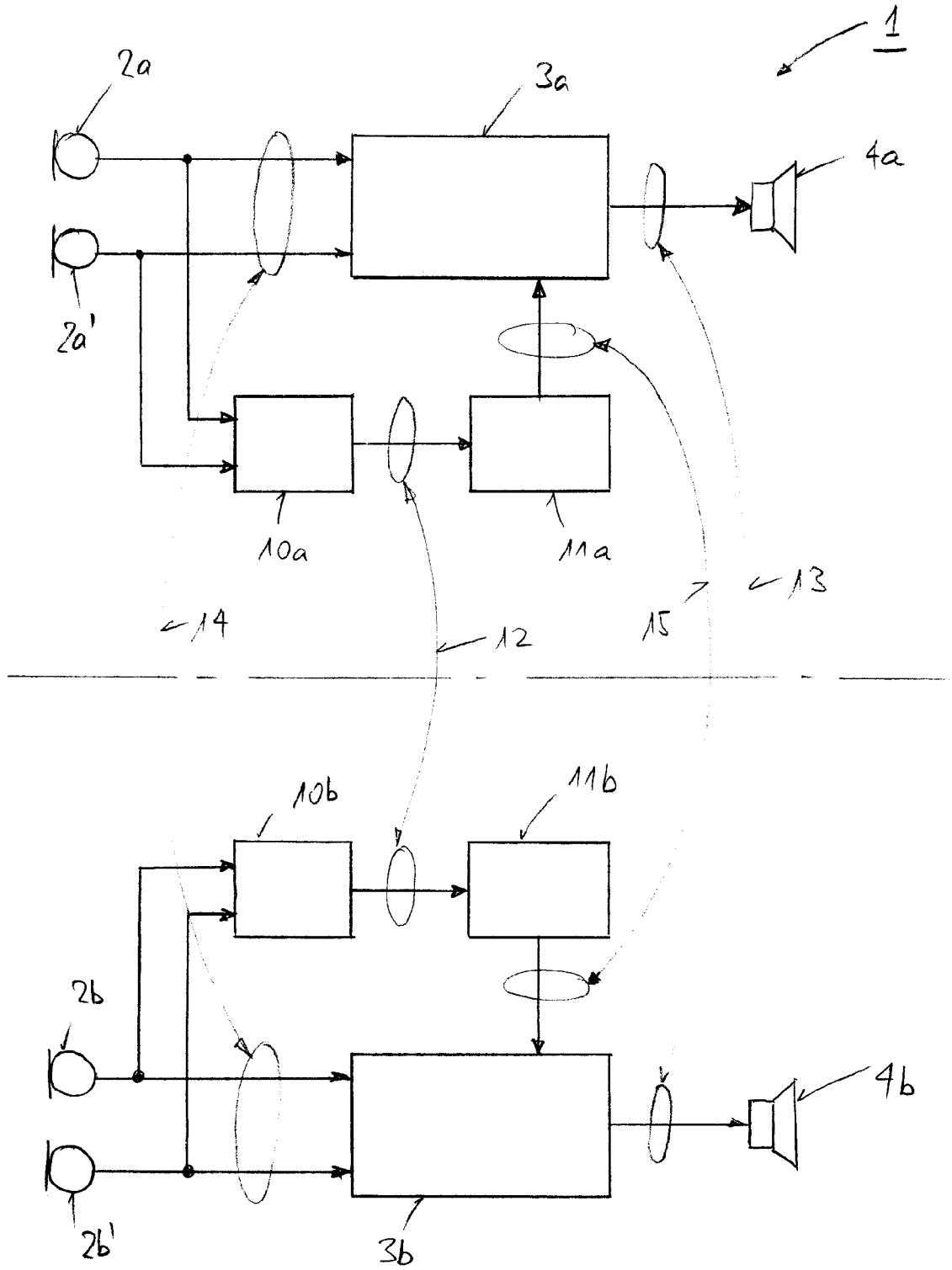

FIG. 1 schematically shows a block diagram of a binaural hearing system comprising two hearing devices and a communication link between the two hearing devices, FIG. 2 shows a partial flow chart of applying a coordination level to ipsi-lateral and contra-lateral information in one of the two hearing devices, and FIG. 3 schematically shows another block diagram of a binaural hearing system.

FIG. 1 schematically shows a block diagram of a binaural hearing system comprising two hearing devices 1 and 2 of identical type. Each hearing device 1, 2 comprises at least one microphone 2*a*, 2*b*, a signal processing unit 3*a*, 3*b*, a loudspeaker 4*a*, 4*b*—often also referred to as receiver in the technical field of hearing devices—, a control unit 5*a*, 5*b* and a receiver/transmitter unit 6*a*, 6*b*.

Audio signals, which are captured by the microphones 2*a*, 2*b*, are fed—in case of a digital hearing device via an analog-to-digital converter (not shown in FIG. 1)—to the signal processing unit 3*a*, 3*b*, in which a transfer function representative for a selected hearing program is applied to the input signal in order to generate an output signal that is fed to the receiver 4*a*, 4*b*, if need be, via a digital-to-analog converter (not shown in FIG. 1). For example, a desired hearing program is selected via the control unit 5*a*, 5*b*, e.g. via a switch at one of the hearing devices or via a software routine that implements a classifier to automatically determine a momentary acoustic situation by analyzing an acoustic signal captured by one or more of the microphones 2*a*, 2*b*. If need be, information is transmitted via the receiver/transmitter unit 6*a* or 6*b*, respectively, to the other hearing device 1 or 2, respectively, either directly or via an external unit 8. The external unit 8 has the function of being able to provide a stable and long-lasting wireless link between the two hearing devices 1, 2 amongst various other possible functions. Thereto, a battery having a large capacity is provided in order to sustain the link as long as possible. Other functions implemented in the external unit 8 may be one or more of the following:

remote control with control means, such as switches, to control the hearing system, e.g. to override automatic settings by manual settings, or vice versa;

display to show the hearing device user an internal status of one or both hearing devices 1, 2;

data logging: information of the two hearing devices can be logged in a large memory unit provided in the external unit 8;

additional microphone.

The information transmitted via the wireless link 7 or 9*a*, 9*b*, respectively, can be one or more of the following:

an acoustic signal captured by one or both of the microphones 2*a*, 2*b;* acoustic parameters of the acoustic signal, such as, for example, sound level, frequency spectra, modulation frequency, modulation depth, level of noise or spatial characteristics;

user control settings, such as volume;

activity levels of one or more of the hearing system functionalities, i.e. beamformer, noise canceller, etc.;

type of algorithms used.

The spatial characteristics of the acoustic situation can in turn include the coherence, incident directions of noise signals, the incident direction of the useful signal, etc.

The terms "contra-lateral" and "ipsi-lateral" are used in connection with the hearing devices throughout this description. For example, information pertaining to the ipsi-lateral hearing device is information of the hearing device being looked at, whereas the other hearing device is called the contra-lateral hearing device. Thus, depending on the point of view, either the left or the right hearing device can be the ipsi-lateral hearing device, the other being the contra-lateral hearing device.

It has already been mentioned that the two hearing devices of a known binaural hearing system are either fully synchronized or they are not at all synchronized, e.g. a corresponding state value is either copied to the other hearing device or not. One of the two hearing devices overrides the setting of the other hearing device entirely depending upon the individually classified acoustic situation. Therefore, known solutions are static in their configuration and fixed in their behavior.

According to the present invention, synchronization between the left and the right hearing device of a binaural hearing system cannot only be to its full extent or not at all, but may be adjusted in-between these extremes. In other words, a synchronization level, hereinafter also called degree of coordination or simply coordination level, is introduced by the present invention. The degree of coordination can be adjusted anywhere in the range of 0 to 100%, 0% meaning no coordination at all, i.e. only ipsi-lateral information is used, and 100% meaning that only contra-lateral information is used in the ipsi-lateral hearing device.

In an advanced binaural hearing device according to the present invention, synchronization of behavior is not always needed or wanted. This may depend upon the individual preferences of the hearing system user as well as upon an asymmetric acoustic situation the user is currently in. Likewise, a certain change in behavior of one hearing device, e.g. in the value of one or several internal states, may or shall not always lead to the same change in the other hearing device. A gradual or a partial synchronization or coordination, respectively, shall be achieved as well. Most preferably, the degree of coordination shall be easily changeable from no coordination, over partial coordination, up to full coordination.

For a hearing system to become inconspicuous to the user while delivering optimal sound processing, its behavior will have to change gradually. Changes of the hearing device parameter settings between different acoustic situations need to be smooth. For symmetric sound situations, i.e. when both hearing devices of a binaural hearing system are exposed to the same acoustic situation, both hearing devices 1, 2 shall usually be in the same state, as, for example, configured by the audiologist. Coordination shall therefore be in such a manner that each hearing device contributes equally its relevant information to achieve a stable acoustical sound perception. For certain asymmetric situations, as it occurs during a telephone call, the hearing devices need to be in different states. In order to facilitate this, the degree of coordination is smoothly changed from e.g. 100% down to e.g. 23%. In this specific example, it makes no sense at all that both hearing devices are operated in the same state since a telephone is only held close to one of the two ears. Therefore, only the hearing devices being close to the telephone must be operated in a hearing program adapted to this specific situation. It makes no sense that the hearing device, which is at the opposite side (the contra-lateral hearing device), is also operated in the same hearing program. On the contrary, it might be still useful for the hearing system user that he can still perceive the acoustic situation that surrounds him. Therefore, the hearing device of the hearing system must not be operated by the same hearing program, i.e. the degree of coordination is to be decreased in this example. The term "hearing program", as it has been used in this example, is to be understood broadly, i.e. already a volume reduction, for example, is interpreted as a hearing program change.

On the other hand, in the example given above, and under the circumstances that the hearing system user is in a room with a very loud noise level, the hearing system user will better hear what is said through the telephone line if the microphone of the contra-lateral hearing device is completely turned off, meaning that there is no coordination at all. Therewith, the extreme surround situation defined by the high noise level is eliminated. The detection of such a situation can be performed by the contra-lateral hearing device, for example. The contra-lateral hearing device is monitoring the momentary surround noise level and proportionally controls the coordination level between the two hearing devices, for example.

In another embodiment of the present invention, coordination shall be set to 0% by the audiologist or the manufacturer, i.e. there is no synchronization at all. With such a fixed low degree of coordination, a lower performance is usually expected for such a hearing system. The advantage lies in the fact that a low cost hearing system can be designed without touching the programming code running in the hearing devices. Thus, no time-consuming verification cycles are needed for software development. In other words, two different hearing system products can easily be tailored by adjusting an appropriate degree of coordination in order to obtain different behaviors without adapting the software code that deals with the coordination of the two hearing devices.

For wireless signal transmission between the hearing device 1 and the further hearing device 2 as well as the external unit 8, the hearing device 1 comprises the receiver/transmitter unit 6*a*. By means of this, the acoustic situation identified in the hearing device 1 is transmitted to the contra-lateral hearing device, i.e. the hearing device 2, and possibly the external unit 8. With the receiver/transmitter unit 6*a*, the ipsi-lateral hearing device in turn receives the acoustic situation analogously determined in the contra-lateral hearing device, i.e. the hearing device 2, and possibly the external unit 8. In this way, the ipsi-lateral hearing device has comprehensive acoustic situation information available to it that is utilized for the control of the transfer function applied to the input signal in the signal-processing unit 3*a*. According to the present invention, the control unit 5*a*, 5*b*, however, accesses at least the acoustic situations of both hearing devices 1 and 2 or—even better—the acoustic situations at all three evaluation locations and correspondingly varies the parameters of the signal-processing unit 3*a*, 3*b*. Individual hearing device functionalities for which a matched effect of both hearing devices 1 and 2 is necessary given binaural coverage are thus coordinated. With the assistance of expedient algorithms, suitable parameters can also be determined given different characteristics for the acoustic situations. Further, the acoustic situations determined at different evaluation locations also allow better statements with respect to the acoustic situation, for example about the acoustic field geometry, which would less well be possible given the determination of characteristics at only one evaluation location.

According to one embodiment, only acoustic parameters and not the acoustic signals picked up at the individual locations are transmitted within the binaural hearing system, keeping the data volume to be transmitted within limits. Nonetheless, a very exact evaluation of the acoustic situation as well as a corresponding coordination of the hearing devices 1, 2 and their adaptation to the acoustic situation is possible.

FIG. 2 shows a partial flow chart to obtain a coordination degree for each of the two hearing devices 1, 2 (FIG. 1). A simple means to do so is by weighted averaging of ipsi-lateral information ILD and contra-lateral information CLD to generate certain states or signals, referred to synchronized data SD in FIG. 2. According to the embodiment depicted in FIG. 2, the ipsi-lateral information ILD is weighted by a weighting factor $1-w$ and added to weighted contra-lateral information CLD, the contra-lateral information CLD being weighted by a weighting factor w. Generally, the weighting factor w can take values from 0 to 1. Thus, for a weighting factor $w=0$, no coordination takes place (coordination level is equal to 0%). For a weighting factor $w=0.5$, a coordination with a coordination level of 50% takes place. For a weighting factor $w=1$, the contra-lateral information CLD from the contra-lateral hearing device is used without any consideration of the ipsi-lateral information, i.e. the coordination level is 100%.

In one embodiment of the present invention, both hearing devices 1 and 2 perform the same operation, only with the ipsi-lateral/contra-lateral information being swapped, i.e. the flow chart depicted in FIG. 2 is implemented in the right hearing device as well as in the left hearing device and the weighting factors w are the same in the left and the right hearing device for full coordination.

In another embodiment of the present invention, the same operation is performed in the left and the right hearing device for the same information but with different weighting factors w. As a consequence thereof, the ipsi-lateral and the contra-lateral information are not weighted the same way in the left hearing device compared to the right hearing device. An example for such an application is given below.

In yet another embodiment of the present invention, the weighting factor or factors, respectively, are gradually changed. Therewith, the behavior of the hearing system can get smoothly changed from no coordination (both hearing devices are independent) via full coordination (both hearing devices get the same information for further processing) up to an inverted case, where each hearing device uses the signal from the opposite, i.e. contra-lateral, hearing device. In order to obtain a smooth transition, means for averaging are provided before the multiplication unit in the CLD-path, i.e. the path providing the contra-lateral information. The means for averaging the contra-lateral information CLD have a small value (or is even equal to zero) at the beginning of the averaging process. As soon as the value for the contra-lateral information changes, the time constant will be increased.

Thus, the weighting factors w may be different for the left and right hearing devices and it may differ between different functionalities, such as beamforming, noise cancelling, etc. These functionalities are also called actuators to emphasis the concept of functionality mixing.

The inventive concept incorporating actuators and the mentioned functionality mixing will be further described in connection with a binaural hearing system depicted in FIG. 3.

FIG. 3 shows a block diagram of a binaural hearing system having a left hearing device 1 (FIG. 3, top) and a right hearing device 2 (FIG. 3, bottom). Each of the two hearing devices 1 and 2 comprise identical blocks, such as two microphones 2*a*, 2*a*' and 2*b*, 2*b*', a signal processing unit 3*a* and 3*b*, a receiver 4*a* and 4*b*, a pre-processing unit 10*a* and 10*b*, as well as a post-processing unit 11*a* and 11*b*. In addition, the binaural hearing system comprises means for transmitting information between the left and the right hearing device 1 and 2 in a similar or equal manner as has been explained in connection with the embodiment depicted in FIG. 1. Nevertheless, such transmission means have not been represented in FIG. 3. Instead, information to be exchanged between the left and the right hearing device is indicated by ellipses enclosing signal paths carrying the information to be transmitted to the contra-lateral hearing device 1 or 2. The corresponding ellipses in the left and right hearing devices 1, 2 are associated by arrows 12 to 15 to indicate the information exchanged. In fact, the arrows 12 to 15 represent the information transmitted via the transmission means (not depicted in FIG. 3).

In each of the ellipses, the partial flow chart depicted in FIG. 2 is implemented, for example, in the corresponding signal path. Thereby, ipsi-lateral and contra-lateral information are combined to obtain synchronized data SD that is used in further processing stage, as for example in the signal processing unit 3*a*, 3*b*, the post-processing unit 11*a*, 11*b* or the receiver 4*a*, 4*b*. The partial flow chart depicted in FIG. 2 is identically used in both hearing devices 1 and 2, whereas the weighting factors w might not be identical, i.e. the weighting factors w can be different even though the same information is taken into account. Therewith, an asymmetric behavior of the binaural hearing system can be obtained, which is favorable in certain situations, as it is the case, for example, during a telephone conversation. In this particular situation, an absolute identical operation of the two hearing devices 1, 2 of the binaural hearing system is not leading to satisfactory results since identical weighting factors for both hearing devices 1, 2 means that both hearing devices act in the same way, i.e. as if both hearing devices 1, 2 receive the telephone signal. Because the telephone can only be held to one ear and the telephone signal can generally only be perceived by one ear, the hearing device that is close to the telephone is preferably operated in a telephone mode while the other hearing device may still receive and process surround signals. In a further embodiment, the telephone signal is also transmitted to the contra-lateral hearing device in order to further improve intelligibility. The volume of the telephone signal on the contra-lateral side is usually reduced in order that the hearing system user can still perceive surrounding sound. In case the level of surrounding sound surpasses a predefined level that is indicative of a very loud surrounding, the microphone signals of the contra-lateral hearing device is completely switched off and the telephone signal of the ipsi-lateral hearing device is fully made available to the contra-lateral hearing device.

Therefore, with an eye on FIG. 2, if a hearing system user wants to concentrate on the telephone conversation and is holding the phone to his left ear, he may wish to have a binaural microphone mixing weighting factor w for his left hearing device to be set close to zero, i.e. no audio signal from the right hearing device (i.e. from the contra-lateral hearing device) reaching the left ear, and a microphone mixing weighting factor w for his right hearing device to be set to between 0.5 and 1, i.e. actually providing the microphone signal of the left hearing device (with the telephone signal) to the right ear with an even higher level than the right hearing device microphone signal. If the weighting factor w is equal to 0 in the hearing device being close to the telephone, and if the weighting factor w is equal to 1 in the other hearing device, the hearing system user receives the same telephone signal at both ears and with identical volume or mixing, respectively.

In a further embodiment, the weighting factor w may be applied just for the frequency rang, in which the telephone signal (speech) is present, i.e. in the frequency range of 300 Hz to 3 kHz. Therefore, and more generally, the weighting factor w may also be frequency dependent.

As an example, the following situation may occur: If a hearing system user is driving a car, his left hearing device may be in omni-directional mode and the volume weighting factor w (volume, left) close to 0.5, while his right hearing device may be in directional mode focusing on the passenger to the driver's right side, with a volume weighting factor w (volume, right) close to zero.

Furthermore, in a further example, if the wireless link should break down due to an overwhelming noise source, graceful degradation of the coordination process can be achieved by replacing the (missing) contra-lateral information with the ipsi-lateral information in the control units 5*a*, 5*b*, for example. Thus, the synchronized information complies with the ipsi-lateral information if the link fails, i.e. an independent behavior will result. This replacement may happen smoothly.

In a still further example to illustrate the present invention, a situation is given, in which the binaural hearing system user has strong wind noise on his left hearing device, but not on the right hearing device, be it as a left-seated driver in a car with the left side window open, or in a situation, where the wind is blowing from the left side. In such a situation, the weighting factor w for the wind-noise canceller must be suitably high on the left side, and the weighting factor w for the wind noise canceller must be suitably low on the right side. Equal values for the weighting factors w—or activity levels—do not make sense. Therefore, the corresponding weighting factors w will be $w_{left}=w_{right}=1$. However, audio signals are preferably synchronized in such a way as to feed the processed right-side audio signal at least partially to the left side. Therefore, the weighting factor w in the left hearing device is equal to 0.5 for the audio signal, for example. In a car situation, it may be desirable that the sound of a second car on the left side, primarily received by the left hearing device, be transmitted to the right hearing device. For example, the weighting factor w for the right hearing device is set to 0.5 for the audio signal. But in other wind-noise situations, for example if a noise source is close to the left ear, there might be no need to transmit left audio signals to the right hearing device.

Therefore, the weighting factor w is equal to 1 for the audio signal.

The above-mentioned inventive concept can get applied for a variety of information. For example, one or several of the following parameters or characteristics can be used as information:

sound field parameters, as for example sound level;
user control settings;
audio signals;
activity levels of noise reduction algorithms, such as noise cancellers, reverberation cancellers, wind noise cancellers, for example;
SNR—(Signal-to-Noise-Ratio);
DOA—(Direction of Arrival) of sound;
any psycho acoustic parameter, such as loudness, for example;
spectral weighting and any other output of spectrally sensitive sensors, features and analyses, such as frequency modulation characteristics and spectral profile information, for example;
tonality;
pitch;
results of amplitude onsets/offsets and modulation analyses as they are well known in speech detection, for example;
results of rhythm extraction methods;
results of own voice detection or detection of another specific voice.

In another embodiment, the information is a measure to indicate the accuracy of each of the microphone 2*a*, 2*a*' and 2*b*, 2*b*', respectively. Based on this measure, the microphones having higher probabilities of providing more accurate signals will obtain a higher weighting factor. Thereby, the overall performance of the binaural hearing system will increase.

In dependency on the information being processed, the weighting factors w are adjusted; thereby different weighting factors are possible for the same information.

In another embodiment, the weighting factors w are adjusted, for example, as a function of the momentary acoustic surround situation being determined by a classifier.

Having thus shown and described what is at present considered as the embodiments of the invention, it should be noted that the same has been made by way of illustration and not limitation. Accordingly, all modifications, alterations and changes coming within the spirit and scope of the invention are herein meant to be included.

The invention claimed is:

1. A method for operating a binaural hearing system comprising at least a contra-lateral hearing device and an ipsi-lateral hearing device being operationally connected to one another via a communication link, wherein the contra-lateral hearing device and the ipsi-lateral hearing device are to be at least partly inserted into or to be worn behind respective ears of a user, each hearing device comprising at least one microphone to generate an electrical signal corresponding to an acoustic signal, the method comprising:

determining contra-lateral information (CLD) based on a first acoustic signal recorded by a microphone of the contra-lateral hearing device, determining ipsi-lateral information (ILD) based on a second acoustic signal recorded by a microphone of the ipsi-lateral hearing device, providing a coordination level, the coordination level being indicative of a degree of synchronization of settings related to audio signal processing within the contra-lateral hearing device and the ipsi-lateral hearing device, and adjusting processes in the ipsi-lateral hearing device in accordance with the coordination level, wherein the coordination level is determined from at least one of the contra-lateral information and the ipsi-lateral information, or is obtained from an external device, and wherein the coordination level represents a partial degree of synchronization greater than no coordination and less than full coordination.

2. The method of claim 1, further comprising:

adjusting processes in the contra-lateral hearing device in accordance with the coordination level.

3. The method of claim 1, further comprising:

determining the contra-lateral information (CLD) in the contra-lateral hearing device, and transmitting the contra-lateral information (CLD) to the ipsi-lateral hearing device.

4. The method of claim 1, further comprising:

determining the ipsi-lateral information (ILD) in the ipsi-lateral hearing device.

5. The method of claim 1, further comprising:

determining a coordination level in each of the two hearing devices.

6. The method of claim 1, further comprising:

replacing the contra-lateral information (CLD) by the ipsi-lateral information (ILD) if the communication link fails.

7. The method of claim 1, wherein the coordination level has a value that is greater than 0% coordination and less than 100% coordination.

8. The method of claim 2, further comprising:

determining the contra-lateral information (CLD) in the contra-lateral hearing device; and transmitting the contra-lateral information (CLD) to the ipsi-lateral hearing device.

9. The method of claim 2, further comprising:

determining the ipsi-lateral information (ILD) in the ipsi-lateral hearing device.

10. A binaural hearing system comprising:

at least a contra-lateral hearing device and an ipsi-lateral hearing device being operationally connected to one another via a communication link, wherein the contra-lateral hearing device and the ipsi-lateral hearing device are to be at least partly inserted into or to be worn behind respective ears of a user, each hearing device comprising at least one microphone to generate an electrical signal corresponding to an acoustic signal, means for determining contra-lateral information (CLD) based on a first acoustic signal recorded by a microphone of the contra-lateral hearing device, means for determining ipsi-lateral information (ILD) based on a second acoustic signal recorded by a microphone of the ipsi-lateral hearing device, means for providing a coordination level, the coordination level being indicative of a degree of synchronization of the two hearing devices, and means for adjusting processes in the ipsi-lateral hearing device in accordance with the coordination level, wherein the coordination level is determined from at least one of the contra-lateral information and the ipsi-lateral information, or is obtained from an external device, and wherein the coordination level represents a partial degree of synchronization greater than no coordination and less than full coordination.

11. The hearing system of claim 10, further comprising:

means for adjusting processes in the contra-lateral hearing device in accordance with the coordination level.

12. The hearing system of claim 10, further comprising:

means for determining the contra-lateral information (CLD) in the contra-lateral hearing device, and means for transmitting the contra-lateral information (CLD) to the ipsi-lateral hearing device.

13. The hearing system of claim 10, further comprising:

means for determining the ipsi-lateral information (ILD) in the ipsi-lateral hearing device.

14. The hearing system of claim 10, further comprising:

means for determining a coordination level in each of the two hearing devices.

15. The hearing device of claim 10, further comprising means for replacing the contra-lateral information (CLD) by the ipsi-lateral information (ILD) if the communication link fails.

16. The hearing system of claim 10, wherein the coordination level has a value that is greater than 0% coordination and less than 100% coordination.

17. The hearing system of claim 11, further comprising:

means for determining the contra-lateral information (CLD) in the contra-lateral hearing device; and means for transmitting the contra-lateral information (CLD) to the ipsi-lateral hearing device.

18. The hearing system of claim 11, further comprising:

means for determining the ipsi-lateral information (ILD) in the ipsi-lateral hearing device.

* * * * *